United States Patent [19]

Lowe

[11] 4,280,249

[45] Jul. 28, 1981

[54] CARD DRIVE OPERATING APPARATUS AND METHOD

[76] Inventor: Jerry B. Lowe, Tr. 1, Box 58, Simpsonville, S.C. 29681

[21] Appl. No.: 20,911

[22] Filed: Mar. 15, 1979

Related U.S. Application Data

[63] Continuation-in-part of Ser. No. 890,253, Mar. 27, 1978, Pat. No. 4,187,585.

[51] Int. Cl.[3] ..... D01G 15/36

[52] U.S. Cl. ..... 19/98; 188/18 A

[58] Field of Search ..... 19/98, 99, 106 R; 188/18 A

[56] References Cited

U.S. PATENT DOCUMENTS

| | | | |
|---|---|---|---|
| 3,530,542 | 9/1970 | Burnham | 19/98 X |
| 3,780,834 | 12/1973 | Lottridge et al. | 188/18 A |
| 3,982,301 | 9/1976 | Llach et al. | 19/106 R |
| 4,187,585 | 2/1980 | Lowe | 19/98 |

FOREIGN PATENT DOCUMENTS

| | | | |
|---|---|---|---|
| 2638120 | 3/1978 | Fed. Rep. of Germany | 19/98 |

*Primary Examiner*—Louis Rimrodt

*Attorney, Agent, or Firm*—Bailey, Dority & Flint

[57] ABSTRACT

A carding machine drive having an instantaneous braking system is illustrated wherein the driven main cylinder and carding components driven therefrom may be stopped instantaneously in about three seconds or less avoiding breakage of the web. A disk element is employed having opposed braking surfaces which are clampingly engaged by caliper means which are fixed to the card frame. The disk element has fixed connection and transverse alignment concentrically with the main cylinder. By driving carding components including the doffer directly from the main cylinder, simultaneous stopping thereof may be achieved. By utilizing conductor bars on component covers removal thereof automatically institutes braking.

6 Claims, 10 Drawing Figures

CARD DRIVE OPERATING APPARATUS AND METHOD

This is a continuation-in-part of copending application Ser. No. 890,253, filed Mar. 27, 1978 now U.S. Pat. No. 4,187,585, Feb. 12, 1980.

BACKGROUND OF THE INVENTION

While electric brakes and the like have been utilized in connection with certain textile carding and drafting apparatus such as illustrated in U.S. Pat. No. 3,530,542 such have proved to be impractical insofar as providing an instantaneous stop. Efforts to utilize electric brakes such as illustrated in the patent have proved to be impractical to create an instantaneous stop and are not serviceable over a long period of time. This is because by their nature they are concentrically mounted and a minimum of lever arm is afforded in order to create stopping torque.

An important advantage of an instantaneous stop is to make it possible to stop the various carding elements associated with or driven by the main cylinder quickly and in proportion so as not to cause the web to come down but rather to remain up so that carding may be resumed quickly. It would thus be possible to stop the card without having to put up the web each time when starting again. This would be of special advantage in stops over the weekend where the card may simply be restarted without having to put the ends up at the beginning of the week.

The instantaneous stopping apparatus is especially desirable for the use when conducting maintenance operations. During maintenance operations the card is blown down or cleaned by blasts of air in which case it is necessary to move the covers and perhaps the clean-out doors at the bottom of the frame. When clearing chokes, it is important that the main cylinder be stopped. This normally takes about ten minutes and operators have the tendency to become impatient and may not realize that the main cylinder is still rotating. Switches for actuating the braking mechanism of the invention may be placed in a number of locations such as on the doors and covers, as well as on the regular panel for the electrical circuitry. It is important that the braking mechanism be carried adjacent the main cylinder shaft on the side of the card.

It has been found to be important in such a system to drive the doffer and associated components as shown directly coupled to the main cylinder to provide a substantially simultaneous stopping of such components avoiding irregularities in the web as well as preventing the web from coming down.

BRIEF DESCRIPTION OF THE INVENTION

It has been found that instantaneous stopping of the main cylinder of a carding machine and associated carding elements may be effected through the use of a disk brake system wherein a disk having opposed braking surfaces concentrically carried in relation to the main cylinder may be secured in fixed relation to the main cylinder and calipers provided for effecting stopping action through suitable circuitry by switches such as actuated by removal of a carding element such as a door or cover or any other suitable device.

Thus, the apparatus of the invention contemplates providing a synchronous stop which is important in that the web is not lost during a cleaning operation and the like avoiding the necessity for putting the end up on each stoppage of the card. It is especially desirable that the doffer and other card components be coupled mechanically directly to the main cylinder and to provide interlock bar means associated with component covers for producing instantaneous braking to avoid loss of the web in all stopping procedures conducted during carding.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a carding machine having a frame carrying a driven main cylinder and drive means connected thereto for driving other carding components therefrom. An instantaneous braking system includes a disk element having opposed braking surfaces A and means B fixing the disk element to the main cylinder in transverse outwardly spaced alignment therewith with the opposed braking surfaces extending outwardly, concentrically of the main cylinder. Caliper means C have spaced opposed brake pads engaging the opposed braking surfaces. Means D are provided for fixing the caliper means in respect of the frame. Switch means E are provided on the carding machine actuating the caliper means for effecting clamping engagement.

Figure 1:
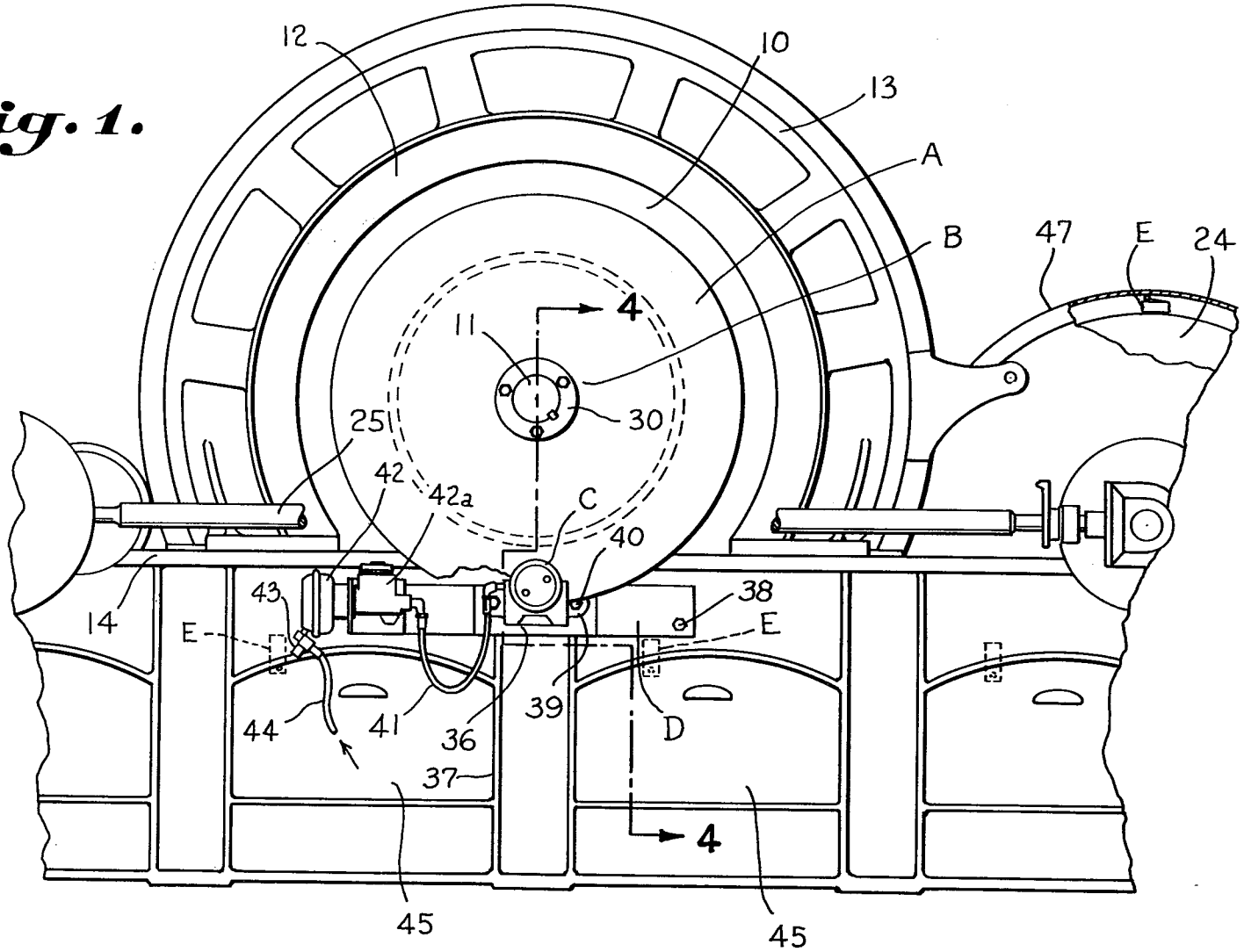
FIG. 1 is a side elevation illustrating a carding machine equipped with the braking mechanism constructed in accordance with the present invention.

The carding machine illustrated in FIG. 1 shows a main cylinder 10 which is carried by a shaft 11 within the arch 12. The arch may be provided with stationary flats as illustrated at 13 or movable flats (not shown) may be employed. The arches 12 are mounted on opposed card frame members 14.

Figure 2:
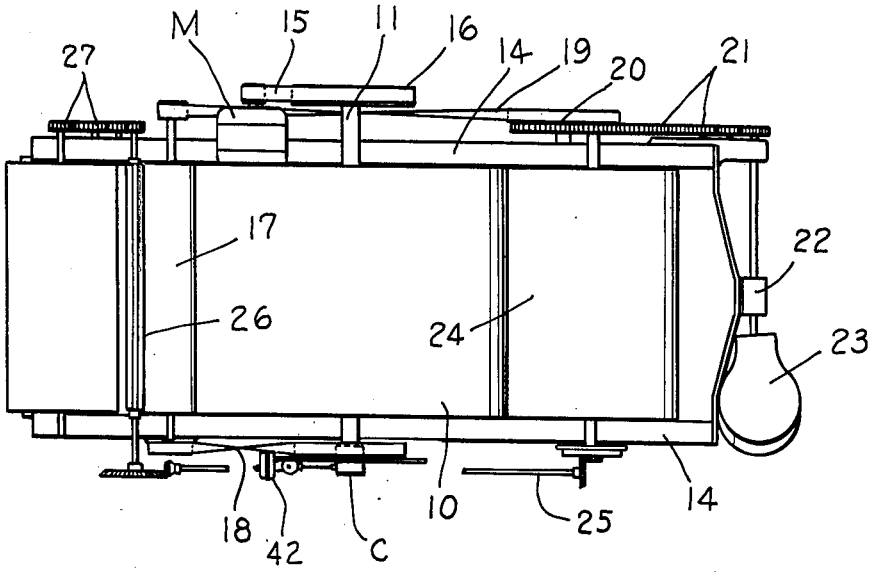
FIG. 2 is a plan view illustrating the positioning of the braking mechanism in relation to the other drive elements of a card.

Referring more particularly to FIG. 2, it will be noted that the main cylinder 10 is driven by a motor M through a power takeoff mechanism which includes a belt 15 which drives the pulley 16 which has fixed connection to a cylinder shaft 11.

The lickerin roll 17 is driven from the main cylinder through a belt 18 and the lickerin, in turn, through a belt drive 19, drives the barrow pulley 20. The barrow pulley 20 through a suitable gear train 21, drives the calendar rolls 22 and certain parts of the coiler 23. The doffer 24 drives through a shaft 25, the feed roll 26 which, in turn, drives suitable feed mechanism through the gear train 27.

Figure 4:
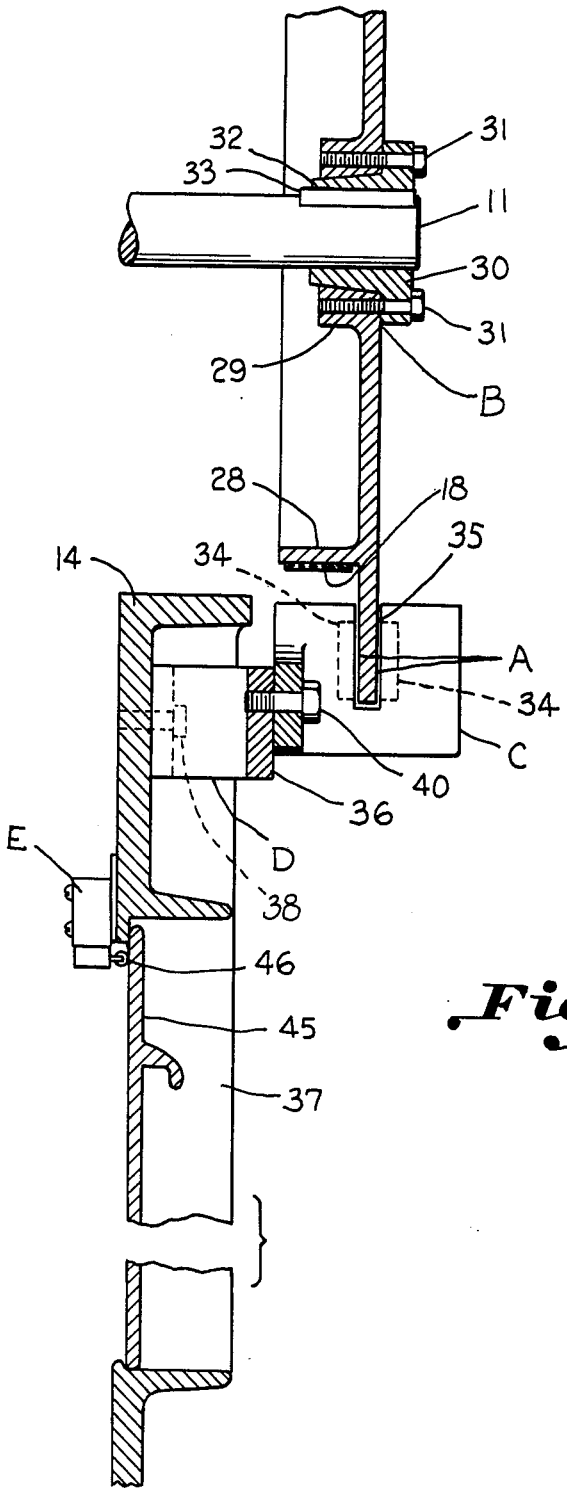
FIG. 4 is a transverse sectional elevation taken on the line 4—4 FIG. 1.

The braking surfaces A of the disk element are machined so as to be in true transverse relationship with the main cylinder and are smooth. The means B includes the bracket which carries the braking surfaces A and as is best seen in FIG. 4, includes a drive pulley 28 for driving belt 18 which in addition, acts as an arcuate reinforcing means. The bracket has a hub member 29 which is secured as by a bushing 30 to the cylinder shaft 11. The bolt 31 threadably tightens the bracket hub 29 upon a tapered portion 32 of the bushing 30. A suitable key 33 secures the tapered member 32 upon the shaft 11. It can be seen that the brake disk element is an extension of the drive pulley surface and the two may be cast as one piece. Separate brake disk and pulley elements, integrally attached are also contemplated.

The caliper means C includes a pair of opposed braking pads 34 which define a space 35 therebetween for accommodating the braking surfaces A. Through suitable fluid operated cylinders, (not shown) the pads 34 are caused to grippingly engage the braking surfaces A. Means D for mixing the caliper in respect to the frame includes a substantially rectangular elongated bracket which has an outwardly projecting central portion 36 for accommodating the vertical braces 37 of the frame members 14. The bracket D is bolted as by bolts 38 to an upper portion of the frame in vertical alignment with the shaft 11 of the main cylinder. A plate 39 is provided for removably securing as by bolts 40, the caliper C to the frame member. Pressurized fluid is provided to the caliper through the line 41 from an air operated hydraulic actuator 42 which pressurizes hydraulic fluid in master cylinder 42*a*. The actuator 42 is afforded with air from a solenoid valve 43 through the line 44 from a suitable source as may be normally associated with the card.

Figure 3:
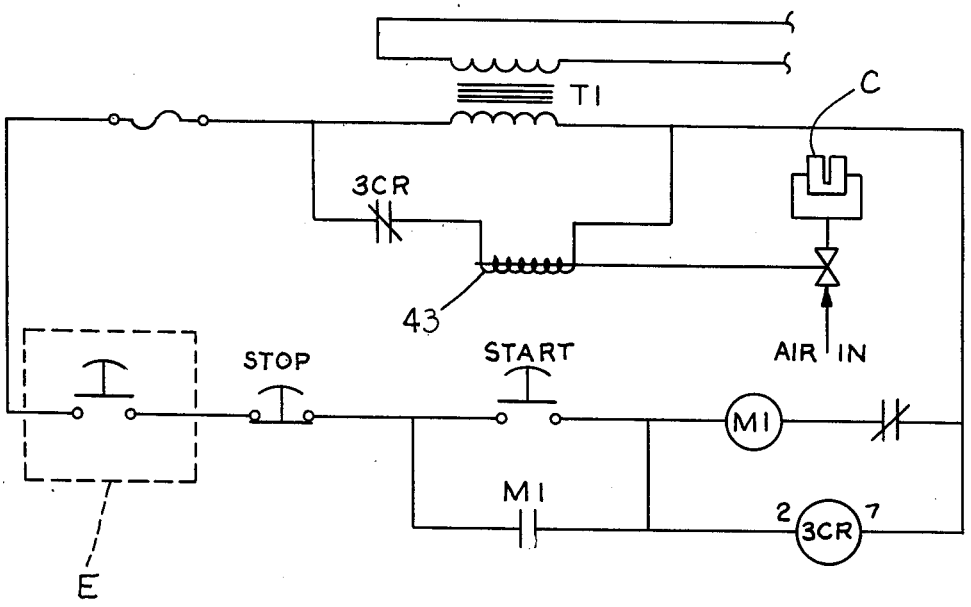
FIG. 3 is a schematic diagram illustrating the various electrical components utilized in operating the braking mechanism in accordance with the invention.

It will be noted that suitable switch means E are associated with each of the cleanout doors 45 carried adjacent a lower portion of the frame. As will be noted from FIG. 4, the cleanout doors 45 maintain the switch means E in open position by depressing the switch lever 46. Similar switches E are associated with a cover member shown schematically and broken away at 47 in FIG. 1 just above the doffer 24. Similar switches may be associated with covers (not illustrated) mounted at any point on the card which will, when actuated, initiate the operation of the brake mechanism.

the switches, one of which is illustrated at E in FIG. 3, are connected in series with the main card control stop switch. The switches may be normally open as illustrated, and are closed by the physical presence of the cover, the door or other part of the card. For example, the weight of a cover mounted on the side of the card may be used to hold the switch closed. A switch E is also illustrated in connection with the doors through the flanges. All the series wired switches must be closed, therefore, all covers or doors must be shut before the supply transformer T can energize the circuit. Assuming all switches to be closed, motor contacts M1 are closed by pushing the start switch. At the same time control relay 3CR is energized and remains energized as long as contacts M1 are closed.

The energized control relay 3CR opens the normally closed contacts which are in series with the three-way solenoid valve 43. De-energizing of the solenoid valve cuts off air line pressure to the brake actuator and allows the brake actuator to bleed to atmospheric pressure. When the actuator pressure is released, the calipers release the brake disk. The cylinder motor starts the cylinder and runs the card.

Disturbing the electrical condition of any of the switches or the stop switch removes power from relay M1 resulting in opening normally open contacts M1. At the same time power is removed from contacts of relay 3CR. This allows closing of the normally closed contacts of 3CR energizing the solenoid valve coil. This allows air to pass to the brake actuator 42 and the caliper to clasp the brake disk. This stops the cylinder in a short time interval, also stopping the lickerin.

As may be seen from FIG. 3, removing power by releasing the M1 contacts also removes control power from all motor relays resulting in power loss to the motor or motors which drive the card. The cylinder and lickerin are stopped by the disk brake. Any other components mechanically coupled to the cylinder are stopped by the brake. Other moving machine elements including the doffer, if disengaged as through a conventional clutch, may coast to a stop. In general, such coasting elements stop in less than two seconds. The stopping rate of the cylinder depends on caliper pressure, but three seconds total stopping time is attainable.

Referring now more particularly to FIGS. 5–10, it will be noted that like reference characters have been utilized to designate like parts to those described above. The main cylinder 19 is driven by a motor M having a motor relay M1 (FIG. 10) for driving the cylinder shaft 11 through the belt 15 and pulley 16. The arch 12 carries stationary flats 13 and is mounted between the usual side frames 14.

Figure 5:
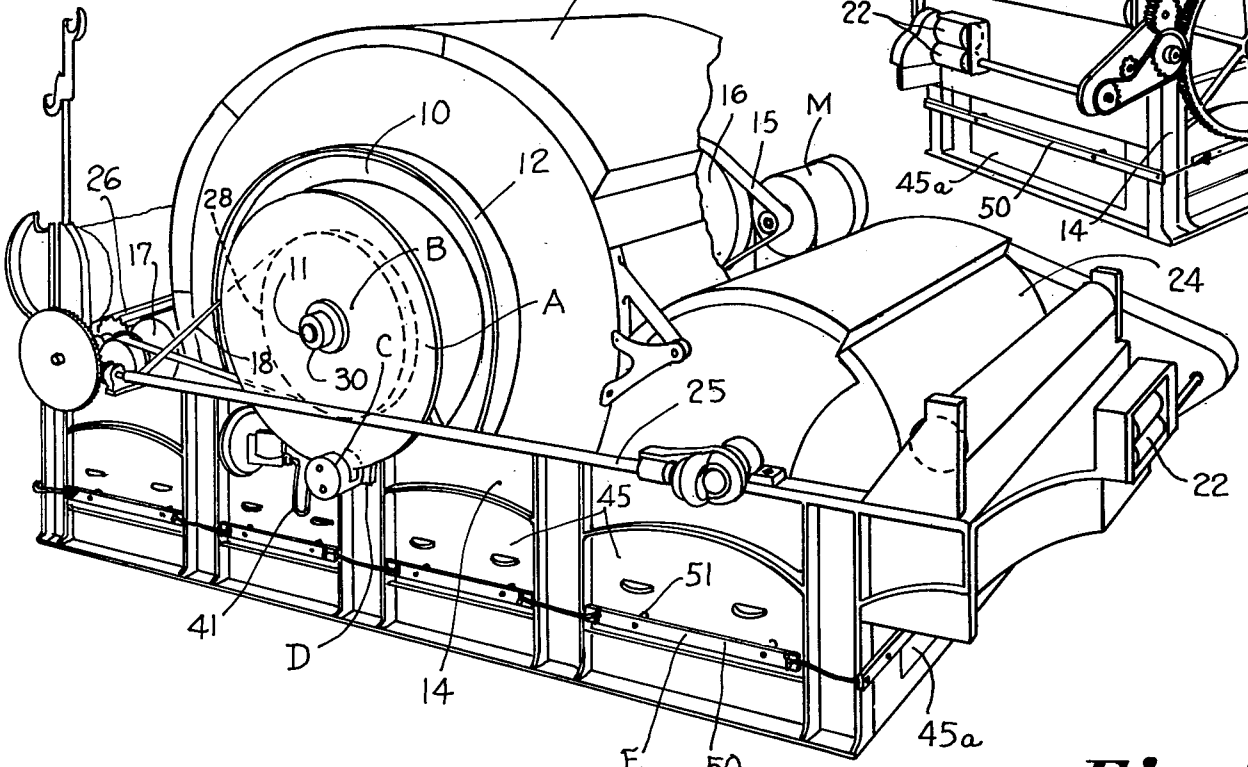
FIG. 5 is a perspective view of a card looking toward the delivery end illustrating interlock bars and drive constructed in accordance with the invention.

The braking surfaces A are illustrated in FIG. 5 as being carried by the bracket B which includes a drive pulley 28 for driving belt 17. The bracket is secured as by a bushing 30 to the cylinder shaft 11. The caliper means C is carried by suitable mounting means D for fixing the caliper means in respect to the frame 14. Pressurized fluid is provided to the caliper through the line 41.

Figure 6:
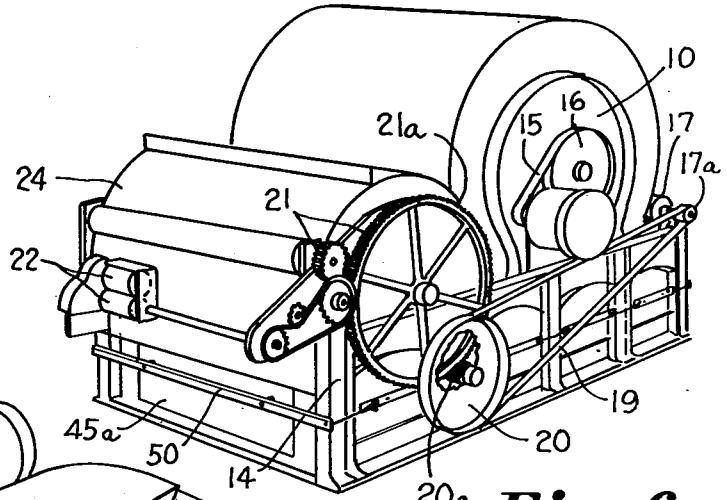
FIG. 6 is a perspective view looking from the other side of the card illustrating a direct mechanical drive from the main cylinder to the doffer.

Referring particularly to FIG. 6, a direct drive is illustrated coupling the doffer 24 to the main cylinder 10 through the belt drive 19 from the pulley 17*a* fized to the lickerin roll 17. The belt drive 19 drives the usual barrow pulley 20 which, in turn, drives the production gear 20*a*. The production gear 20*a* drives the calendar rolls 22 and associated parts, including coiler elements, through the gearing 21 which includes the usual doffer gear 21*a*. The drive includes a shaft 25 for driving the feed roll 26 and associated components through the gear train 27.

As has been noted above, such a direct coupling to the main cylinder provides a simultaneous stop for the main cylinder and all of the other components directly coupled thereto. By braking the components instantaneously and stopping them substantially simultaneously with respect to each other, any fiber buildup or other irregularity in the web is avoided. By an instantaneous stop with or without the direct drive, the coming down of the web is avoided as described above.

Figure 7:
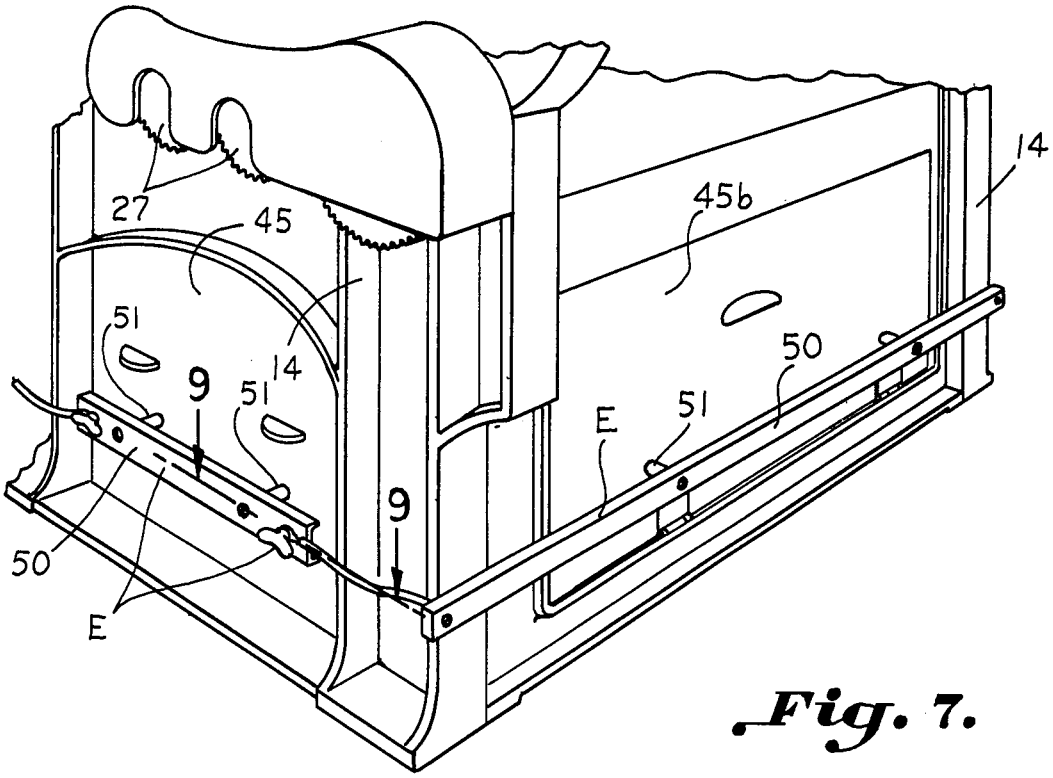
FIG. 7 is an enlarged perspective view looking toward the feed end of the card.
Figure 8:
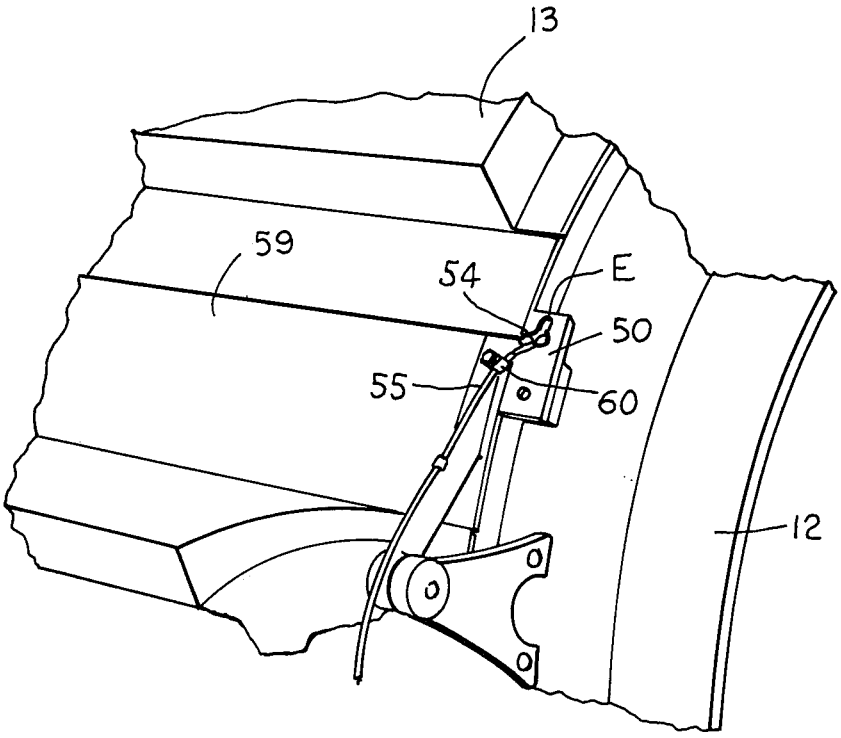
FIG. 8 is a perspective view of a front door plate further illustrating the interlock system.
Figure 9:
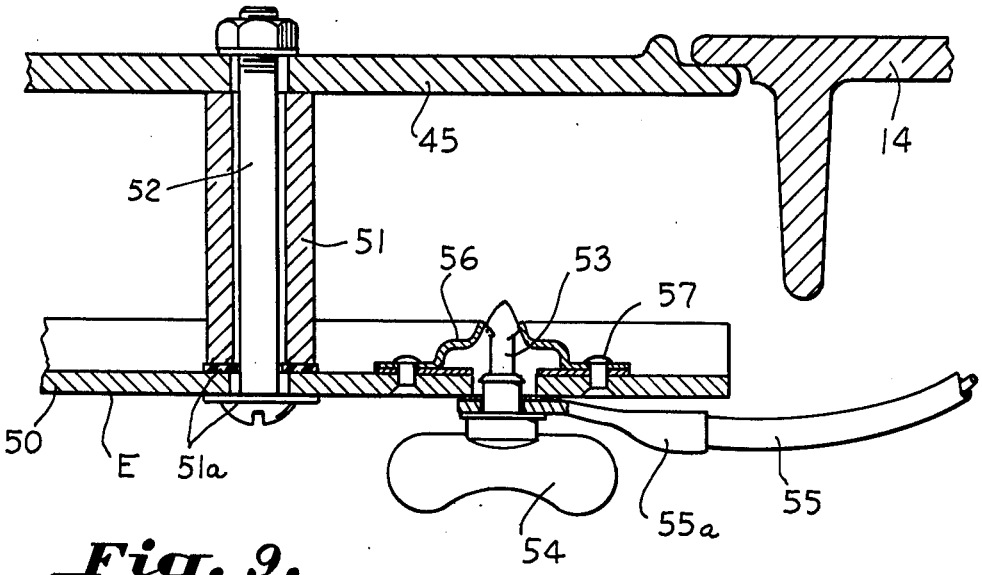
FIG. 9 is an enlarged sectional plan view taken on the line 9—9 in FIG. 7.
Figure 10:
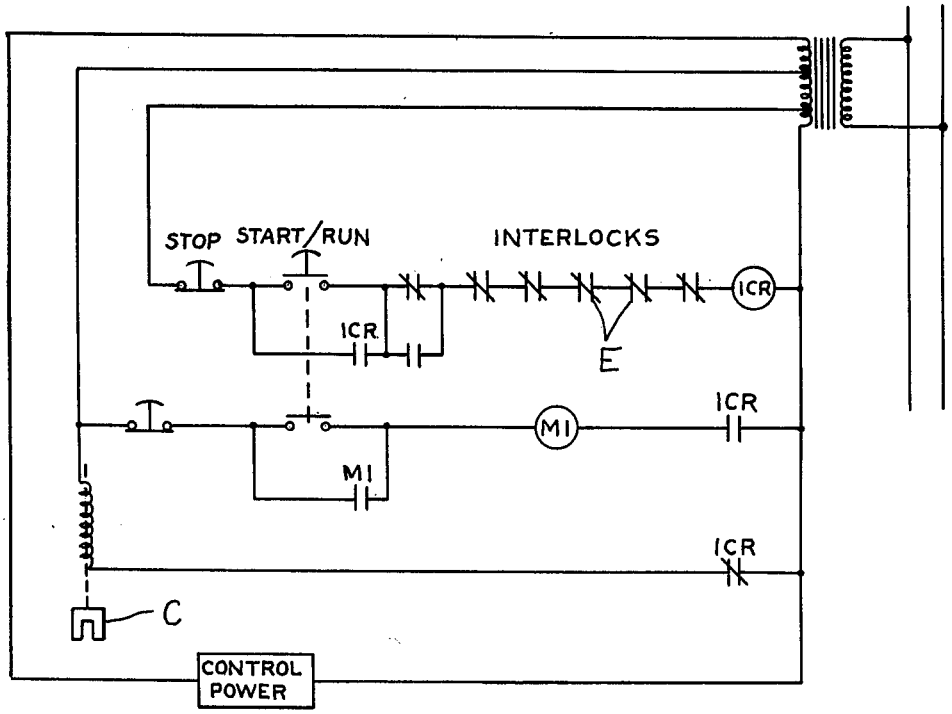
FIG. 10 is a schematic diagram further illustrating the interlock system.

FIGS. 5, 7 and 8 illustrate the utilization of a series of elongated bars 50 which are interlocks, in this instance constituting switching means E. The elongated bars 50 are carried by insulated mounting means including sleeves 51 made of suitable non-conductive material which space and insulate the bars from the doors. Insulating washers 51*a* may be provided. Suitable fastening means such as bolts 52 (FIG. 9) secure rigid conductor bars 50 across the side doors 45, as well as the front and rear doors 45*a* and 45*b*, respectively. By further reference to FIG. 9, it will be noted that a male portion 53 of a suitable quick disconnect coupling has a wing portion 54 to facilitate coupling and uncoupling of the insulated flexible cable 55 which carries an end fitting 55*a* to facilitate connection. The portion 53 is received within the female receptacle 56 which is secured as by suitable fasteners 57 adjacent end portions of the bars 50. The cables 55 are carried between the bars in the series of bars illustrated as extending about the card across the access covers or doors. It will be noted that by disconnecting a quick coupling at either end of a bar 50 that a cover such as a door 45 may be removed as for a cleanout.

The front door plate which is illustrated 2*t* 59, may be removed by pivoting same downwardly after disconnecting the quick disconnect coupling by turning the wing portion 54 (FIG. 8). It will be noted that the insulated flexible cable or coupling 55 is connected as by a lug strap 60 to the front door plate 59.

Closing the start contacts (FIG. 10) applies voltage to all 1CR contacts closing the normally open contacts and opening the normally closed contacts, provided the card interlocks are all closed. Any open interlock will negate power to 1CR contacts. Applying power to the 1CR closes the normally open contacts enabling the motor relay M1. The motor relay is energized by pressing the start switch, closing normally open contact M1.

If at any time, card interlock is opened, 1CR is deenergized opening both sets of normally open contacts. In the example shown, the 1CR normally closed contacts apply a voltage to the solenoid brake valve which, in turn, brakes the card to a stop. If any interlock is not closed, attempting to restart the card will fail.

The regular maintenance operations carried out during carding, such as cleaning which requires the removal or dislodgement of cover elements and the like, are greatly facilitated through utilization of the interlocks and braking system described herein. By directly coupling the drive of the doffer and other associated components to the main cylinder, a simultaneous stopping of the components is effected avoiding variation in sliver thickness, greatly facilitating carding and saving the time of operating personnel as well as reducing machine downtime.

While a preferred embodiment of the invention has been described using specific terms, such description is for illustrative purposes only, and it is to be understood that changes and variations may be made without departing from the spirit or scope of the following claims.

What is claimed is:

1. A drive for a card having a motor for driving various carding elements including a main cylinder and other carding components, said carding elements having cover elements comprising:

electrically actuated braking mechanisms for instantaneously stopping said carding elements;

a series of elongated conductor bars;

insulating mounting means carrying said bars on respective cover elements;

fasteners carried by respective bars providing a quick disconnect coupling with an adjacent conductor bar permitting removal of a bar with removal of a respective cover;

conducting means connecting adjacent bars; and means for actuating said braking mechanism responsive to disconnecting of a quick disconnect coupling and removal of a respective bar and cover.

2. The structure set forth in claim 1 wherein said conducting means are flexible cables having a quick disconnect means adjacent an end thereof.

3. The structure set forth in claim 2 wherein said bars are each carried by spaced insulating mounting means and extend across respective covers.

4. The method of driving a carding machine having a driven main cylinder carried for rotation on a transverse axial shaft, and means feeding fiber to the cylinder and a doffer removing a web therefrom driven from said main cylinder comprising the steps of:

instantaneously braking the main cylinder by exerting a gripping force radially of said axial shaft directly to said cylinder;

coupling the means feeding fibers and the doffer directly to the main cylinder by mechanical connecting means;

causing a stopping of said feed means and said doffer responsive to the stopping of the main cylinder simultaneously therewith; and thereafter again driving the main cylinder as well as the feeding means and doffer therefrom so as to avoid the web coming down.

5. The method set forth in claim 4 including positioning a series of conducting bars for actuating instantaneous braking responsive to disconnecting a bar from said series.

6. The method of driving a carding machine having a driven main cylinder carried for rotation on a transverse axial shaft, and means feeding fiber to the cylinder and a doffer removing a web therefrom driven from said main cylinder comprising the steps of:

instantaneously braking the main cylinder by exerting a gripping force radially of said axial shaft directly to said cylinder;

causing a stopping of said feed means and said doffer responsive to the stopping of the main cylinder; and thereafter again driving the main cylinder as well as the feeding means and doffer therefrom so as to avoid the web coming down.

* * * * *